United States Patent [19]

Franklin

[11] 4,088,170

[45] May 9, 1978

[54] ROMAN STYLE DRAPE PULL CORD SUPPORTS

[76] Inventor: Edna M. Franklin, 1500 NW. 35, Oklahoma City, Okla. 73118

[21] Appl. No.: 721,749

[22] Filed: Sep. 9, 1976

[51] Int. Cl.[2] ..... A47H 5/032; A47H 11/06

[52] U.S. Cl. ..... 160/84 R

[58] Field of Search ..... 160/84 R, 133, 178 C, 160/344

[56] References Cited

U.S. PATENT DOCUMENTS

| | | | |
|---|---|---|---|
| 1,973,933 | 9/1934 | Shehan | 160/178 C |
| 3,092,172 | 6/1963 | Anderson | 160/133 |
| 3,383,733 | 5/1968 | Johnson | 160/344 |
| 3,777,800 | 12/1973 | Susoev | 160/84 R |

*Primary Examiner*—Peter M. Caun
*Attorney, Agent, or Firm*—Robert K. Rhea

[57] ABSTRACT

Improved pull cord supports for a pull-up horizontal pleat forming curtain or drape employing a generally rectangular body of fabric suspended by the upper edge thereof from a horizontally disposed bar at the upper limit of a window or building opening to be covered and uncovered. A plurality of control cords are extended along vertical paths throughout the height of the drape with the cords being individually entrained over intermediate pulley-like supports attached to the bar with all the cords passing as a unit through a pulley equipped bracket support at one end of the bar and forming a drawstring end portion permitting the drape to be vertically raised and lowered.

3 Claims, 7 Drawing Figures

ROMAN STYLE DRAPE PULL CORD SUPPORTS

BACKGROUND OF THE INVENTION

1. Field of the Invention

The present invention relates to window curtains or drapes generally known as Roman style shades and more particularly to a flexible fabric curtain or drape depending from a support bar attached to a window head and friction reducing pull cord supporting members for raising and lowering the drape.

2. Description of the Prior Art

It has been the general practice to support the pull cords for Roman style drapes by passing them through eye screws secured to a drapery support bar secured to a window head. One end of the cords being attached to the depending edge portion of the drape and extended upwardly in a vertical path. Each vertical path of the cord being defined by a plurality of vertically spaced eyelets or rings secured to the back side of the drape through which the individual cords pass thus generating a substantially 90° bend in the cord as it moves from its vertical path into a horizontal path through the eye screw toward one side of the drape where all cords must also pass as a unit through another eye screw secured to the support bar in a right angular turn in response to a downward pull on the cords when lifting a drape. The resulting friction against the eye screws rapidly wears out the pull cords necessitating their replacement. This frictional wear has been alleviated to some extent by using pull cords formed from synthetic material, such as that generally known under the tradename Nylon, however, this frictional wear also shortens the expected life span of synthetic cords.

Some patents, as shown by the prior art, have attempted to reduce the friction wear on the cords and decrease the force needed to lift the drape by providing pull cord supporting pulleys, such as disclosed by U.S. Pat. Nos. 3,478,805 and 3,593,772, or the use of rollers, as disclosed by U.S. Pat. No. 3,946,788. However, the use of rollers or pulleys have usually resulted in the cords, when in a slackened state, comming off the pulley or roller and being disposed between one end of the roller and its support sometimes resulting in a binding action in which the cord cannot be moved in either direction and which consequently quickly wears the cord if the tolerance is such that the cord may be pulled. This disadvantage is particularly evident when using small diameter synthetic cord material.

This invention overcomes the above objections of eye screws and conventional pulleys or rollers attached to a drapery support bar by providing a friction reducing pulley support which maintains the respective pull cord or collected cords properly entrained over the respective pulley.

SUMMARY OF THE INVENTION

A generally rectangular section or panel of drapery fabric is suspended by one edge attached to a horizontal support bar suitably fixed to the frame or window head forming the upper limit of a window or building opening. An elongated rod-like drapery weight is disposed within a suitable loop formed in or attached to the drapery adjacent its depending edge for maintaining the drapery fabric in a vertical plane and to hasten its descent when released by the pull cords. A plurality of pull cords are attached to the depending edge portion of the drapery fabric in selected spaced relation, the numbering and spacing, depending upon the width of the drapery, its mass and the desired width of pleats formed when the drapery is lifted. Each cord is extended in a vertical path from the bottom to the top of the drapery panel and interleaved through vertically spaced eyelets or loops secured to the back surface of the fabric facing the window being covered. The vertical spacing between the eyelets or loops securing the cords in the vertical paths being selected in accordance with the desired width of the resulting horizontal bellows-like pleats or folds when the drapery is lifted.

A pulley support frame is secured to the drapery support bar in cooperative alignment with the vertical path of each pull cord. Intermediate their ends the pull cords are entrained over the respective pulley and extended toward one side of the drapery panel where the collected cords are entrained as a unit through a double-pulley equipped corner support frame permitting the cords to be pulled, in drawstring fashion, downwardly and slightly laterally of the plane of the window and/or drapery panel for belaying the free end portions of the pull cords around a cleat or other suitable fastener attached to one stile of a window frame thus maintaining the drapery panel in a selected lifted or window uncovered position.

The principal object is to provide substantially trouble free pulley type supports for minimizing friction and wear of the pull cords used in raising and lowering Roman style drapes.

DESCRIPTION OF THE PREFERRED EMBODIMENT

Figure 1:
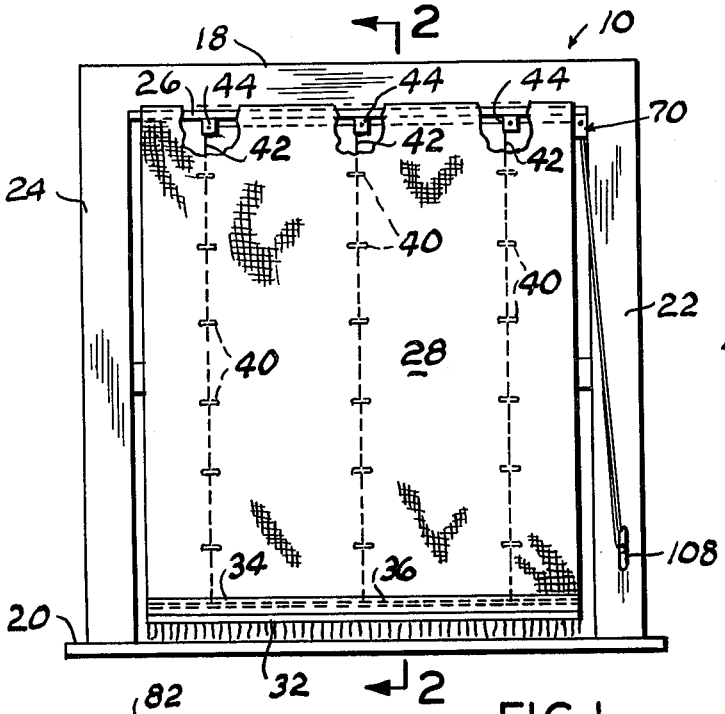
FIG. 1 is an elevational view of a drapery covered window, with portions of the drapery panel broken away for clarity, as viewed from inside a building.

Like characters of reference designate like parts in those figures of the drawings in which they occur.

In the drawings:

The reference numeral 10 indicates a window frame defining a rectangular opening 12 normally closed by double-hung windows 14 and 16. Obviously, the window opening may be closed by a single pane of glass, or the like, not shown. The window frame 10 includes a head 18, a sill 20 and stiles 22 and 24. The above description is conventional with windows in a residential building, or the like, and is set forth to show the components with which the invention is intended to be used.

Figure 2:
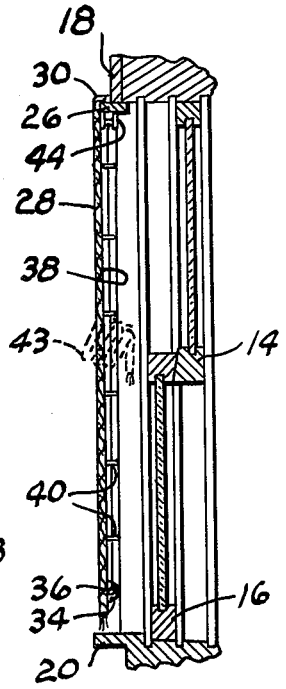
FIG. 2 is a fragmentary vertical cross sectional view taken substantially along the line 2—2 of FIG. 1 and illustrating, by dotted lines, a raised portion of the drapery panel.
Figure 5:
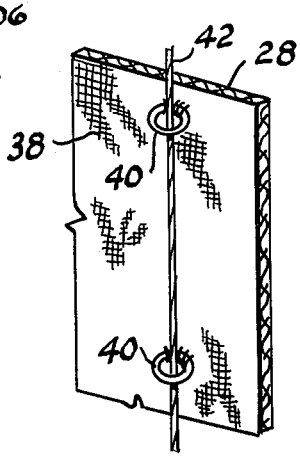
FIG. 5 is a fragmentary perspective view illustrating the manner of connecting a vertical run of one of the pull cords to the back surface of the drapery panel.
Figure 4:
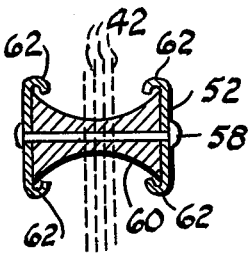
FIG. 4 is a horizontal sectional view taken substantially along the line 4—4 of FIG. 3 illustrating the relative position of a plurality of pull cords by dotted lines.

In carrying out the invention a support bar 26, of selected rectangular transverse cross section and longitudinal dimension, usually coextensive with the width of the window opening and formed of wood, is horizontally attached to the window head 18. A fabric drapery panel 28, having overall dimensions for covering the window opening 12, is longitudinally secured by its top edge portion 30 to the bar 26 in a conventional manner. The support bar 26 and top edge portion of the drapery panel 28 are usually covered by a valance, not shown. The bottom or depending edge 32 of the drapery may be provided with a decorative edge or border, if desired. A loop 34 is transversely formed in the drapery panel in selected spaced relation with respect to its depending edge 32 for receiving an elongated metallic rod 36 which acts as a weight for maintaining the drapery panel in a vertical plane. The rearward surface 38 of the drapery panel, adjacent the windows, is provided with a plurality of rows of small diameter rings 40 which are secured, as by stitching or sewing the rings to the fabric material (FIG. 5), to form a plurality of parallel laterally spaced-apart vertical rows and define a like plurality of vertical paths, three in the example shown, for pull cords 42. The rings 40 are equally spaced-apart vertically, a distance commensurate with the desired transverse width of bellows-like pleats or folds 43 (FIG. 2) to be generated by the drapery panel when lifted, and thus form a plurality of horizontal rows of rings. The depending end portion of each pull cord, disposed in the respective vertical path, is secured to the rod weight 36.

A plurality of intermediate friction reducing pulley-like pull cord supports 44, one for each of the pull cords 42, are connected to the depending surface of the bar 26 in cooperative alignment with the vertical path of the respective pull cord. The respective pull cord 42 is entrained, intermediate its ends, through the respective pulley support.

The respective pulley support 44 includes a pulley frame preferably formed from a section of metallic sheet material 46 characterized by a substantially square frame head or central portion 48 and substantially square end portions 50 and 52. The end portions are bent at a 90° angle with respect to the plane of the central portion 48, along the dotted lines 54, to dispose the end portions 50 and 52 in confronting parallel spaced relation. The end portions 50 and 52 are centrally apertured, as at 56, in aligned relation for receiving a pin 58 journalling a spool-like pulley 60 between the ends 50 and 52. The respective end portions 50 and 52 are each provided with opposed marginal edge wing sections 62 relatively narrow when compared with the dimensions of the end portions. These wing portions 62 are arcuately curved inwardly in confronting relation and partially overlap a peripheral portion of the end flanges of the pulley 60. The purpose of the arcuate wings 62 is to prevent an intermediate portion of any one of the pull cords 42 entering the spacing between either flanged end of the pulley 60 and the adjacent pulley frame end portion 50 or 52 thus maintaining the pull cords entrained over the pulley 60. The pulley frame of each intermediate pulley support 44 is attached to the bar 26 as by a screw, not shown, inserted through a suitable opening 64 formed in its top portion 48. The pulley top portion 48 includes an upstanding lug 66 which, by engaging the material of the bar 26, prevents horizontal rotation of the pulley support 44 about the vertical axis of its mounting screw hole 64.

A somewhat similar double-pulley equipped pulley window frame corner pulley assembly 70 is mounted at one end of the bar 26 laterally of the drapery panel 28, for example adjacent the stile 22. The purpose of the pulley assembly 70 is for receiving the collected plurality of pull cords 42 as a unit for raising and lowering the drapery panel, as presently explained.

Figure 7:
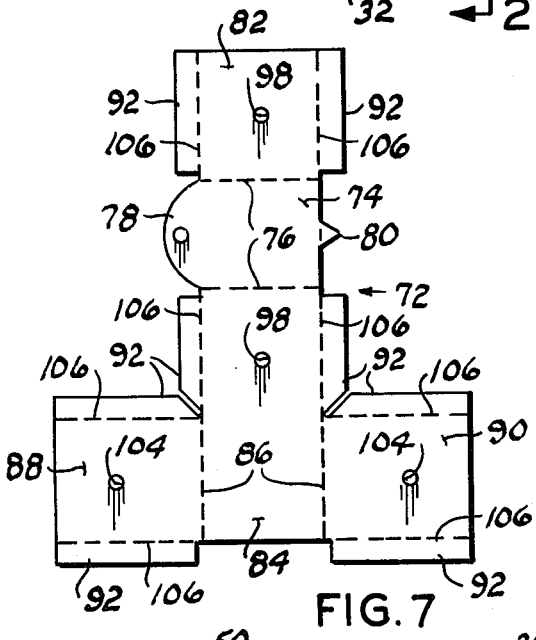
Figure 3:
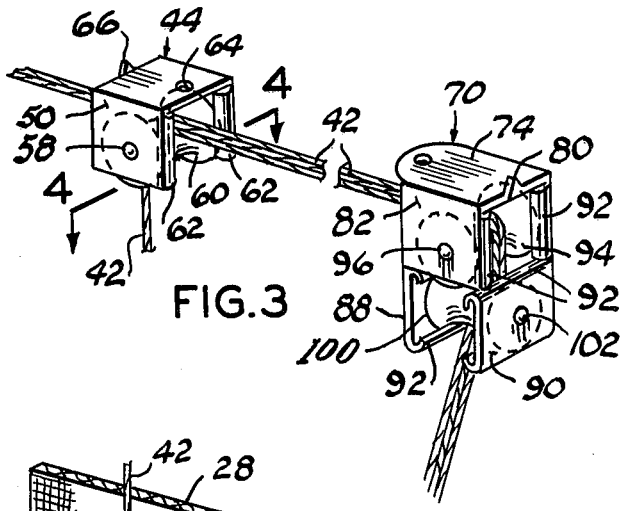
FIG. 3 is a fragmentary perspective view illustrating an intermediate and a corner drapery pull cord pulley support in operative position.
Figure 6:
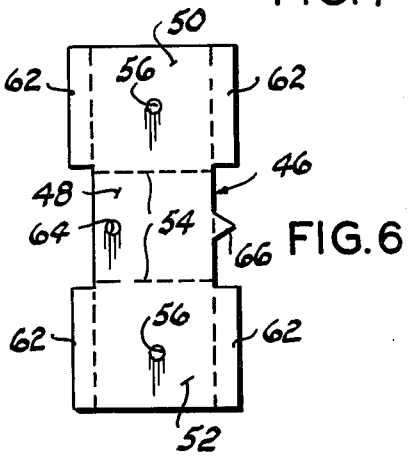
FIG. 6 is a plan view illustrating the manner of forming an intermediate pull cord pulley support frame; and, FIG. 7 is a plan view illustrating the manner of forming the corner pull cord pulley support frame.

The assembly 70 includes a pulley frame similarly formed from a section of metallic sheet material, cut out as indicated at 72 (FIG. 7), which comprises a frame head or top portion 74 having side limits, indicated by the dotted bend lines 76, an arcuate apertured screw receiving extension 78 and a lug or prong 80 at its side opposite the apertured extension. The top 74 is integrally joined to a side panel 82 identical with the intermediate pulley frame end portion 50 and an opposing side panel 84. The side panel 84 is inverted T-shaped, as viewed in FIG. 7, with the stem of the T-shape defined by bend lines 86 and the bar portion of the T-shape defining opposing panels 88 and 90 identically shaped with respect to the side panel 82. Each of the side panels 82 and 84 and end panels 88 and 90 are provided with opposed marginal edge wing sections 92. The side panels 82 and 84 are bent at right angle with respect to the plane of the pulley frame top portion 74 along the dotted bend lines 76 to dispose them in parallel spaced confronting relation for receiving another pulley 94 identical with respect to the pulley 60 which is horizontally journalled by a pin 96 extending through aligned apertures 98. The end panels 88 and 90 are similarly bent at right angle with respect to the plane of the side panel 84 to lie in parallel spaced confronting relation below the side panels 82 and 84, as viewed in FIG. 3, for receiving another pulley 100 horizontally journalled by a pin 102 extending through aligned openings 104 formed in the side panels 82 and 84. The wing sections 92 are similarly bent inwardly along their respective bend lines 106 to overlap a peripheral flanged edge portion of the respective pulley 94 and 100. A mirror image of the pulley assembly 70, not shown, for the other side of the window frame is formed by bending the pulley frame side, end and wing sections in an opposite direction than that just described.

OPERATION

The drapery panel 28, sized to fit the window opening 12, having the bar 26 attached to the window head, is provided with the weight 36 and a plurality of rows of pull cord receiving rings 40 prior to attaching it to the bar 26. The pull cords 42 are attached to the rod weight 36 in line with the respective vertical row of rings 40 and each pull cord is entrained in a vertical path through its respective row of rings. Each pull cord is then entrained over the pulley 60 of the respective intermediate pulley support 44.

As viewed in FIG. 1, the pulley support 44, adjacent the window stile 24, will contain only one pull cord 42 whereas the medial pulley support 44 has two pull cords entrained thereover and the pulley support 44, adjacent the window stile 22, has all three pull cords entrained therethrough. The collected pull cords are then entrained, as a unit, over the pair of pulleys 94 and 100 thus permitting the pull cords, as a unit, to be pulled downwardly and slightly laterally of the plane of the window frame 10 so that the free end portions of the pull cords may be belayed around a cleat 108, or the like, attached to the depending end portion of the window stile 22.

When it is desired to uncover or partially uncover the window opening by raising the drapery panel 28, the pull cords are released from the cleat 108, if secured thereto, and manually pulled generally downwardly to partially or fully lift the drape. When the drape has been lifted to a desired height the pull cords are belayed around the cleat 108 and support the drape in the lifted position. The drape when lifted by reason of the cords being connected to its back side in horizontal vertically spaced rows of rings 40 generate decorative folds or pleats in the fabric, indicated by the dotted lines 43.

When the drape is to be lowered, the pull cords are released from the cleat 108 which permits the mass of the fabric material and rod weight 36 to lower the drape by gravity wherein the pull cords by frictional contact rotate the respective pulleys thus minimizing wear on the cords.

Obviously the invention is susceptible to changes or alterations without defeating its practicability. Therefore, I do not wish to be confined to the preferred embodiment shown in the drawings and described herein.

I claim:

1. In a pull-up drape for a window frame having stiles and having a support bar horizontally secured to the window head, said drape having a width extending between said stiles, a back side, and top and bottom portions, said top portion being secured to said support bar, the improvement comprising:

a plurality of rings secured in vertically spaced relation to the back side of said drape for forming a plurality of parallel vertical paths extending between the top and bottom portions of said drape;

an intermediate pulley support secured in depending relation to said support bar in cooperative alignment with the respective vertical path, said intermediate pulley support including an intermediate pulley frame having a top portion flatly contacting said support bar, and having spaced-apart parallel depending end portions;

a pin extending horizontally between and secured to said intermediate pulley frame end portions;

a spool-like pulley having flanged ends journalled by said pin, each intermediate pulley frame end portion having its vertically disposed marginal edge portions arcuately curved inwardly in confronting relation to form wings overlapping a peripheral portion of the respective flanged end of said pulley to form a horizontal pull cord guide path spaced inwardly from said flanged ends through said intermediate pulley frame; and, a plurality of pull cords each entrained at one end portion through the horizontal guide path of the respective intermediate pulley support and respective row of rings forming the vertical paths and secured to said drape bottom portion.

2. The combination according to claim 1 and further including:

a corner pulley support secured in depending relation to one end portion of said support bar adjacent one said stile, said corner pulley support including a corner pulley frame having a top portion flatly contacting said support bar and having spaced-apart depending parallel side panels and a pair of end panels integral with one said side panel and projecting laterally thereof in spaced-apart parallel depending relation with respect to said side panels;

a pair of pins respectively extending horizontally between and secured to said side and end panels in vertically spaced right angular relation; and, a pair of spool-like pulleys, each having flanged ends, journalled by said pins, each side and end panel of said corner pulley frame having marginal edge portions arcuately curved inwardly in confronting relation to form wings overlapping a peripheral portion of the respective flanged end of the respective pulley of said pair of pulleys and define communicating horizontal and vertical guide paths through said corner pulley frame for limiting lateral movement of said pull cords toward the flanged end of the respective pulley of said pair of pulleys.

3. The combination according to claim 2 and further including:

a loop coextensive with the width of said drape formed through its bottom portion; and, a rod-like weight disposed within the drape said loop.

* * * * *